US008967518B2

(12) United States Patent
Guo

(10) Patent No.: US 8,967,518 B2
(45) Date of Patent: Mar. 3, 2015

(54) WIRE WINDER AND PERIPHERAL COMPONENT HAVING THE WIRE WINDER

(71) Applicants: Fu Tai Hua Industry (Shenzhen) Co., Ltd., Shenzhen (CN); Hon Hai Precision Industry Co., Ltd., New Taipei (TW)

(72) Inventor: Ji-Bing Guo, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 100 days.

(21) Appl. No.: 13/710,724

(22) Filed: Dec. 11, 2012

(65) Prior Publication Data

US 2013/0168481 A1 Jul. 4, 2013

(30) Foreign Application Priority Data

Dec. 28, 2011 (CN) ..... 2011 1 0447050

(51) Int. Cl.
*B65H 75/48* (2006.01)
*B65H 75/38* (2006.01)
*B65H 75/44* (2006.01)

(52) U.S. Cl.
CPC ..... *B65H 75/38* (2013.01); *B65H 75/4431* (2013.01); *B65H 75/4434* (2013.01); *B65H 2701/34* (2013.01)
USPC ..... 242/378; 242/378.1; 242/378.2; 242/378.3; 242/378.4

(58) Field of Classification Search
CPC . B65H 75/48; B65H 75/4431; B65H 75/4434
USPC ..... 242/378, 378.1–378.4
See application file for complete search history.

(56) References Cited

U.S. PATENT DOCUMENTS

| | | | | |
|---|---|---|---|---|
| 6,405,961 | B1 * | 6/2002 | Mastrangelo | 242/378.1 |
| 6,866,218 | B2 * | 3/2005 | Liao | 242/378.1 |
| 7,455,255 | B1 * | 11/2008 | Chao | 242/378.1 |
| 2007/0001046 | A1 * | 1/2007 | Wu | 242/378.1 |

* cited by examiner

*Primary Examiner* — Sang Kim
(74) *Attorney, Agent, or Firm* — Novak Druce Connolly Bove + Quigg LLP

(57) ABSTRACT

A wire winder for winding a wire includes a housing, a latching portion, a rotary assembly, a torsion spring, a cover coupled to the housing, and an operation portion. The rotary assembly can rotate to wind the wire into the housing or unwind the wire out of the housing. The torsion spring is fixed between the rotary assembly and the cover. The operation portion is capable of moving in a telescopic manner, to make the latching portion lock or unlock the rotary assembly. The wire winder further includes at least one location member and a through portion. The at least one location member and the through portion define a wire channel for the wire. The outer end of the wire passes through the at least one location member and the through portion and extends out of the housing through a wire hole defined on the housing.

14 Claims, 6 Drawing Sheets

WIRE WINDER AND PERIPHERAL COMPONENT HAVING THE WIRE WINDER

BACKGROUND

1. Technical Field

The disclosure relates to a wire winder capable of winding a wire of an peripheral component, such as an earphone, a keyboard, or a mouse.

2. Description of Related Art

Some peripheral components, such as, earphones, mice, or keyboards, of electronic devices, may include a wire to connect the peripheral component to the electronic device (e.g., mobile phones, or computers). However, the wire of the peripheral components may become tangled and cause inconvenience. Therefore, there is room for improvement in the art.

BRIEF DESCRIPTION OF THE DRAWINGS

The accompanying drawings are included to provide a further understanding of the disclosure, and are incorporated in and constitute a part of this application. The drawings illustrate embodiments of the disclosure and, together with the description, serve to explain the principles of the disclosure.

DETAILED DESCRIPTION

Figure 1:
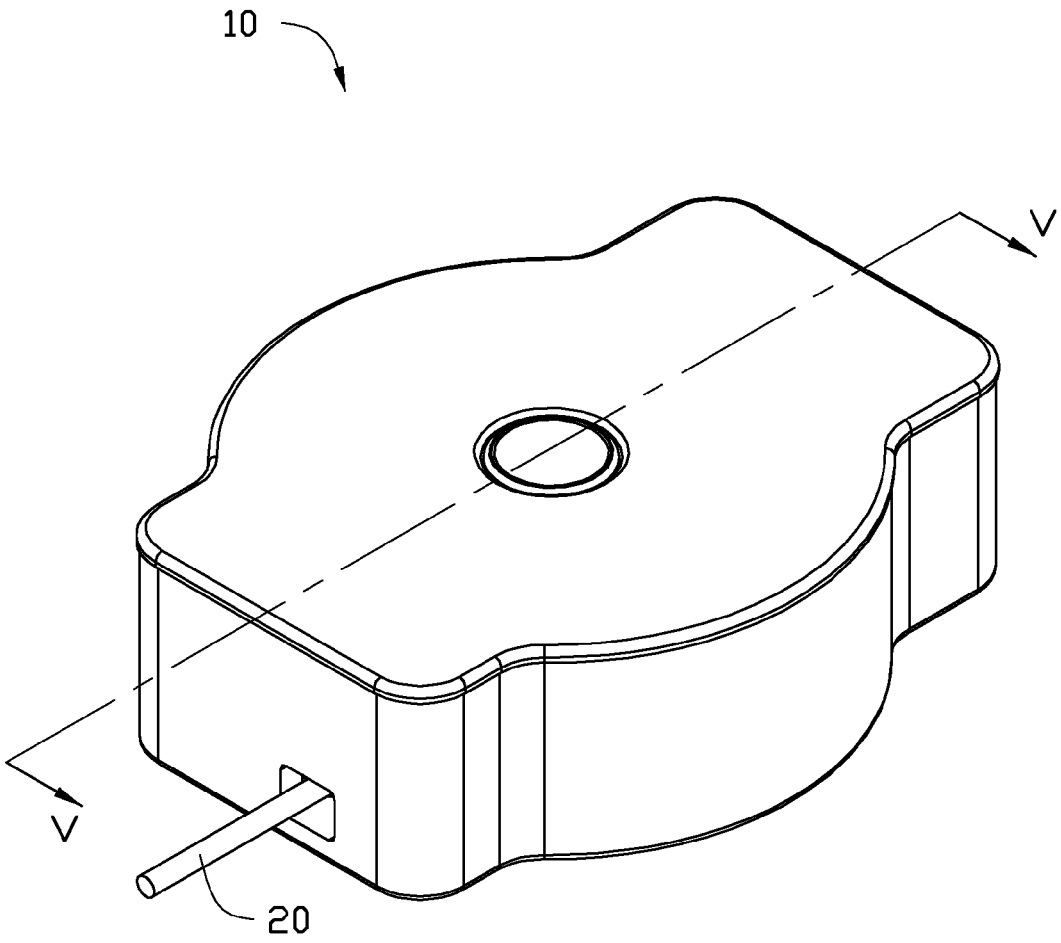
FIG. 1 is an assembled view of a wire winder according to an exemplary embodiment of the present disclosure.

Examples of the present embodiments are illustrated in the accompanying drawings. Wherever possible, the same or similar reference numbers are used, in the drawings and the description, to refer to the same or like parts.

Referring to FIG. 1, is an assembled view of a wire winder 10. The wire winder 10 is configured for winding a wire of a peripheral component (e.g., an earphone, a keyboard, or a mouse) and thus prevents the wire from getting entangled. In one embodiment, the wire winder 10 may be an independent structure apart from the peripheral component. In another embodiment, the wire winder 10 may be integrated into/onto the peripheral component according to different requirements.

Figure 2:
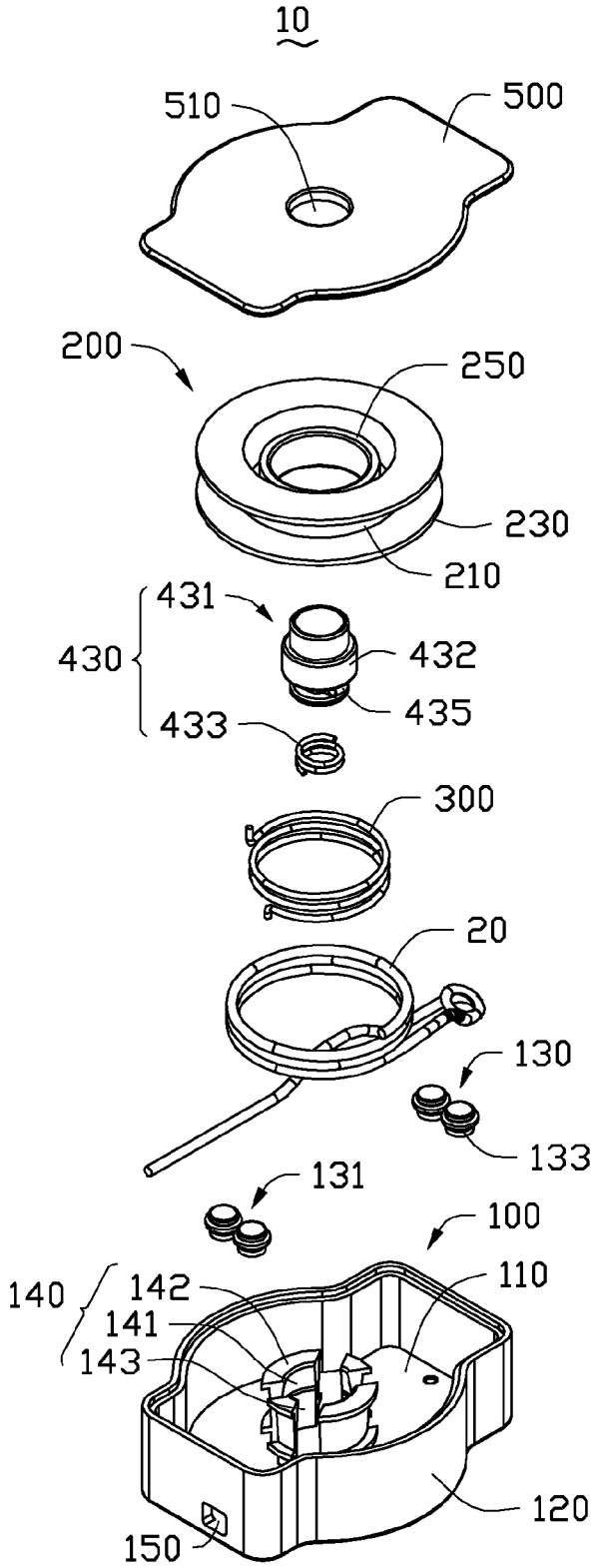
FIGS. 2 and 3 are exploded perspective views viewed from two reverse directions of the wire winder of FIG. 1.
Figure 3:
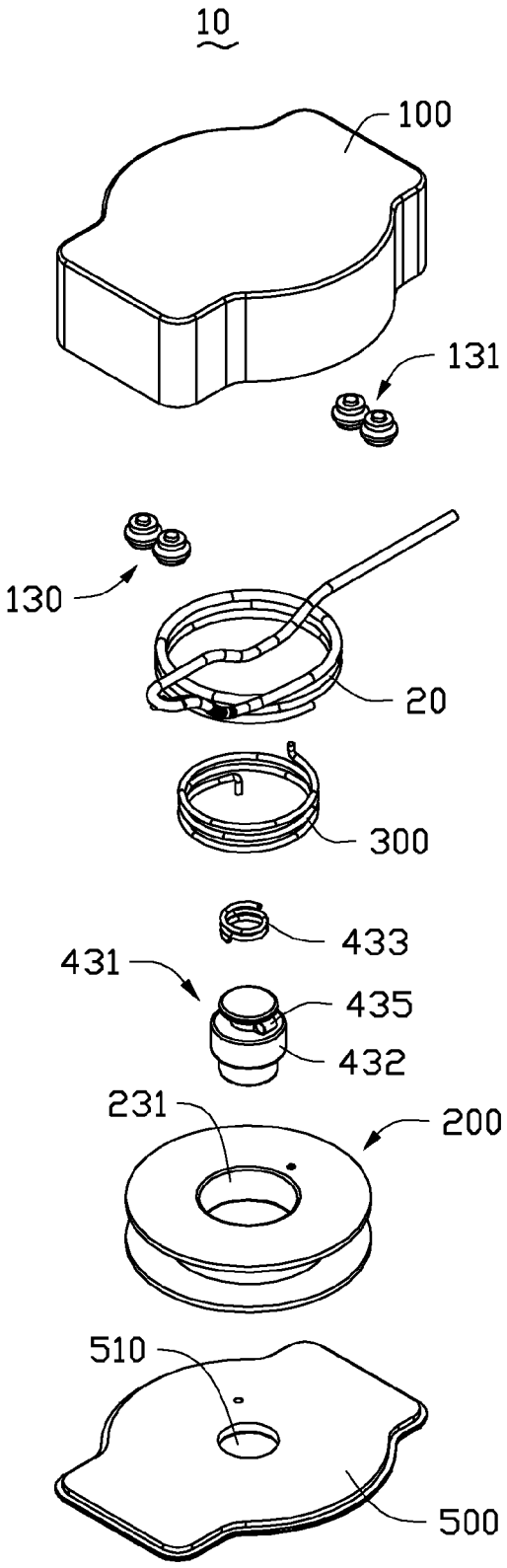

Referring to FIG. 2 and FIG. 3, exploded views of the wire winder 10 are given, viewed from two reverse directions. The wire winder 10 includes a housing 100, a rotary assembly 200, a torsion spring 300, a latching portion 140, an operation portion 430, and a cover 500 coupled to the housing 100. The housing 100 receives the rotary assembly 200, the torsion spring 300, the latching portion 140, and the operation portion 430. The wire 20 of the peripheral component is wound around the rotary assembly 200 and is received in the housing 100.

The two ends of the torsion spring 300 are respectively fixed to the rotary assembly 200 and to the cover 500. Thereby, the torsion spring 300 is fixed into the rotary assembly 200. A wire hole 150 is defined on the housing 100 whereby the wire 20 is drawn out or rewound in the housing 100. The rotary assembly 200 rotates along a first direction when the wire 20 is drawn out of the housing 100 through the wire hole 150, and the torsion spring 300 elastically deforms and stores a certain amount of potential energy. When the wire 20 needs to be rewound, the torsion spring 300 gradually releases this energy to drive the rotary assembly 200 to rotate along a second direction opposite to the first direction, thereby automatically rewinding the wire 20 into the housing 100. A fingertip, or other external force applied to the operation portion 430 drives the latching portion 140 to selectively lock or unlock the rotary assembly 200.

The housing 100 includes a base plate 110 and a sidewall 120 extending from an edge of the base plate 110. The latching portion 140 is a hollow cylinder extending from the base plate 110. The latching portion 140 includes a holding portion 143, a latching body 141, and a restriction portion 142. The holding portion 143 holds the latching body 141. The latching body 141 has a certain amount of flexibility to resist the rotary assembly 200 and lock the rotary assembly 200. The restriction portion 142 is defined on a top of the latching body 141. The rotary assembly 200 is sleeved over the latching body 141, and the restriction portion 142 restricts the vertical movement of the rotary assembly 200, thereby preventing the rotary assembly 200 from moving up and down and escaping from the latching body 141. In the embodiment, the latching body 141 is a wedge-shaped structure extending from an edge of the holding portion 143. The restriction portion 142 is a retaining wall extending from a top edge of the latching body 141 to the sidewall 120.

The rotary assembly 200 includes a base substrate 230 adjacent to the base plate 110, a positioning wall 250, and a wire winding portion 210. The wire winding portion 210 is a fat cylinder extending from the base substrate 230 to the cover 500. The positioning wall 250 is a hollow column extending from the base substrate 230. The base substrate 230, the wire winding portion 210 and the positioning wall 250 cooperate to define a receiving space for receiving the torsion spring 300. The base substrate 230 further defines a through hole 231 throughout the rotary assembly 200, in which the latching portion 140 and the operation portion 430 are received. The through hole 231 is surrounded by the positioning wall 250.

The positioning wall 250 is sleeved on the latching body 141 and the holding portion 143 and sandwiched between the base plate 110 and the restriction portion 142 of the latching portion 140, so that the rotary assembly 200 can rotate around the latching portion 140. In detail, when the latching body 141 is expanded by an external force applied to the latching body 141, the latching body 141 comes into contact with the positioning wall 250 of the rotary assembly 200, and friction between the latching body 141 and the internal surface of the positioning wall 250 locks the rotary assembly 200. Without an external force being applied to the latching body 141, the positioning wall 250 sleeved on the latching body 141 is free to rotate.

An annular groove is defined between the positioning wall 250 and the wire winding portion 210. The torsion spring 300 is sleeved on the positioning wall 250 and received in the annular groove, to cause the potential energy of the torsion spring 300 to rotate the rotary assembly 200 when the torsion spring 300 is released.

The operation portion 430 is received in an inner space defined by the latching body 141, the restriction portion 142, and the holding portion 143 of the latching portion 140. The operation portion 430 includes a button body 431 and an elastic member 433. The elastic member 433 is sleeved on and fixed to one end of the button body 431. In this embodiment, the button body 431 is connected to the base plate 110 via the elastic member 433. The button body 431 includes a protrusion 432 configured for pressing against and deforming the latching body 141 of the latching portion 140, to expand the latching body 141. The button body 431 can be a column-shaped roller. The protrusion 432 is defined at a middle portion of the roller.

In the embodiment, the wire winder 10 further includes a first location member 130, a second location member 131, and a through portion 435. The first location member 130 and the second location member 131 are positioned at opposite sides of the base plate 110, to sandwich the latching portion 140. The second location member 131 is adjacent to the wire hole 150. The first location member 131 and the second location member 132 are horizontally arranged on the base plate 110. The through portion 435 is fixed to the end of the operation portion 430 which is adjacent to the elastic member 433. The first location member 130, the second location member 131, and the wire hole 150 are arranged in a straight line.

Figure 4:
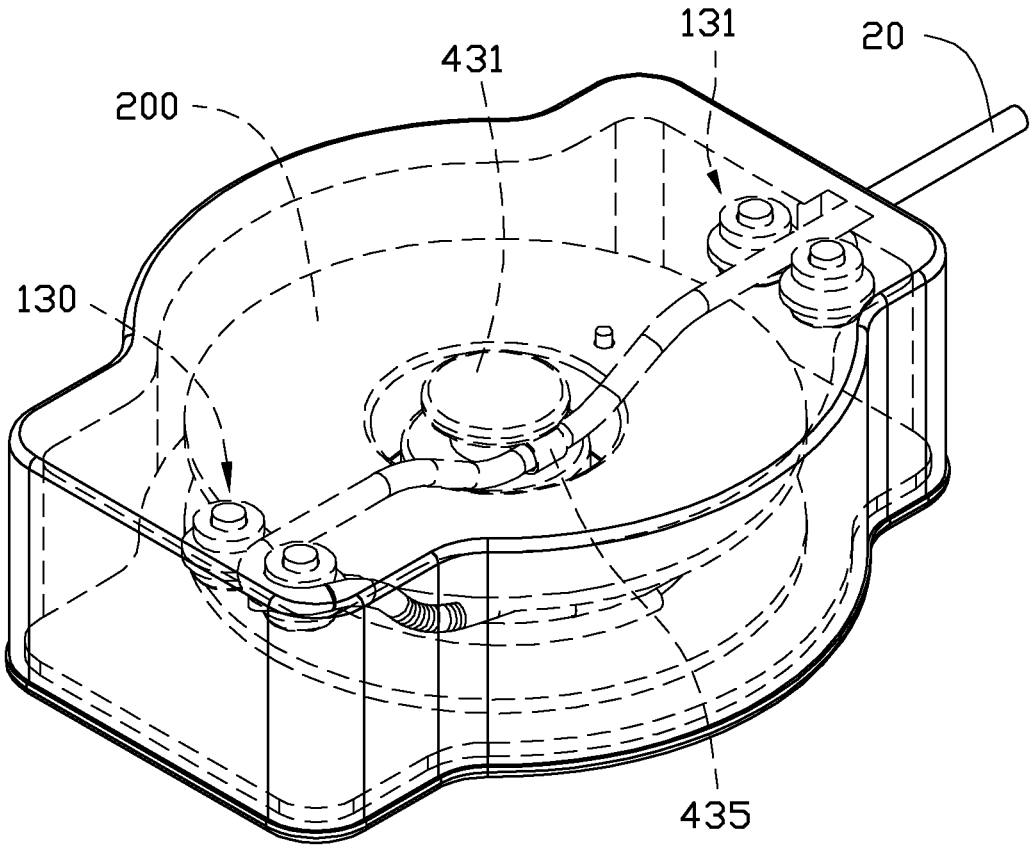
FIG. 4 illustrates a transparent view of a wire wound in the wire winder of FIG. 1.

Referring to FIG. 4, the outer end of the wire 20 passes through the first location member 130, the through portion 435, and the second location member 131 in that order, and extends out of the housing through the wire hole 150. Thus, the first location member 130, the through portion 435, and the second location member 131 corporately define a wire channel for the wire 20. The wire 20 can be drawn out of or rewound into the housing 100 around the wire channel by pulling the outer end of the wire 20.

In the embodiment, each of the first location member 130 and the second location member 131 includes a pair of location rollers 133. The two location rollers 133 define a clearance therebetween to allow the wire 20 to pass through. The pair of location rollers 133 of each of the first location member 130 and the second location member 131 contact with and clamp the wire 20. The clearance between the pair of location rollers 133 of the first location member 130 is narrower than the clearance between the pair of location rollers 133 of the second location member 130, so that friction between the wire 20 and the first location member 130 is greater than the friction between the wire and the second location member 131 during any pulling action applied to the wire 20. A portion of the wire 20 winds around one of the location rollers 133 of the first location member 130, passes through the through portion 435 and a gap between the two rollers 133 of the second location member 131, and extends out of the wire hole 150. In other embodiments, the second location member 131 can be omitted, and the wire channel is defined by the first location member 130, the through portion 435, and the wire hole 150.

The cover 500 includes an opening 510 to allow a portion of the button body 431 of operation portion 430 to protrude out of the housing 100 through the opening 510, thereby enabling a user to operate an exposed end of the operation portion 430.

In assembly of the wire winder 10, the rotary assembly 200 is sleeved on the latching portion 140 through the through hole 231, to make the latching portion 140 extend into the receiving space, and the positioning wall 250 to be received and sandwiched between the restriction portion 142 and the base plate 110. The operation portion 430 is fixed to the base plate 100 via the elastic member 433 and partly received in the inner space defined by the latching portion 140. Then, the torsion spring 300 is sleeved on the positioning wall 250, and one end of the torsion spring 300 is fixed to the rotary assembly 200. The wire 200 is wound around the wire winding portion 210 of the rotary assembly 200, and the outer end of the wire 20 is passed through the first location member 130, the through portion 435, and the second location member 131 and drawn out of the wire hole 150. Thereupon, the other end of the torsion spring 300 is fixed to the cover 500, and the cover 500 is secured on the top edge of the housing 100, with a top portion of the button body 431 passing through the opening 510 and protruding from the cover 500. After the wire winder 10 is assembled, a portion of the wire 20 has a bent portion near the through portion 435. At this time, the torsion spring 300 is not under tension and stores no potential energy.

Figure 5:
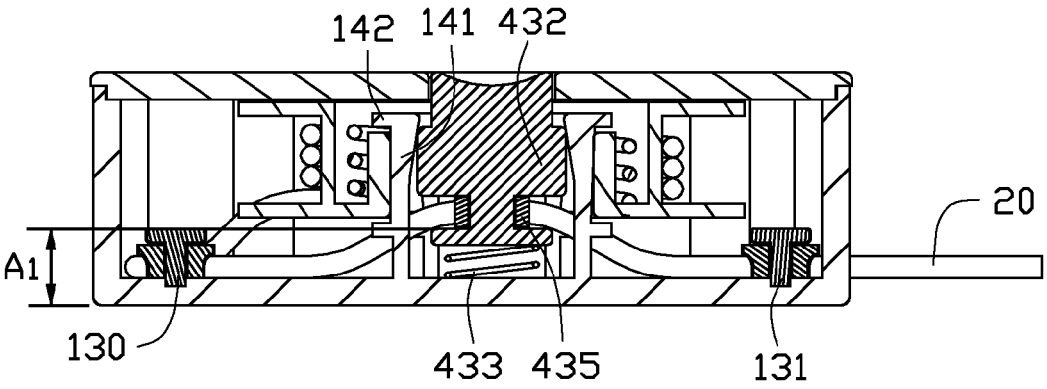
FIG. 5 is a cross-sectional view of the wire winder shown in FIG. 1 along the line of V-V.

Referring to FIG. 5, in operation, before the wire 20 is drawn out of the housing 100 through the wire hole 150, the latching body 141 is latched to the positioning wall 250 due to the resistance of the protrusion 432 of the operation portion 430, and the rotary assembly 200 is locked by the latching portion 140. The first location member 130 and the second location member 131 are located on the base plate 110. At this time, the through portion 435 is located at a position which has a first vertical distance A1 to the base plate 110. The bent portion of the wire 20 is at the through portion 435.

Figure 6:
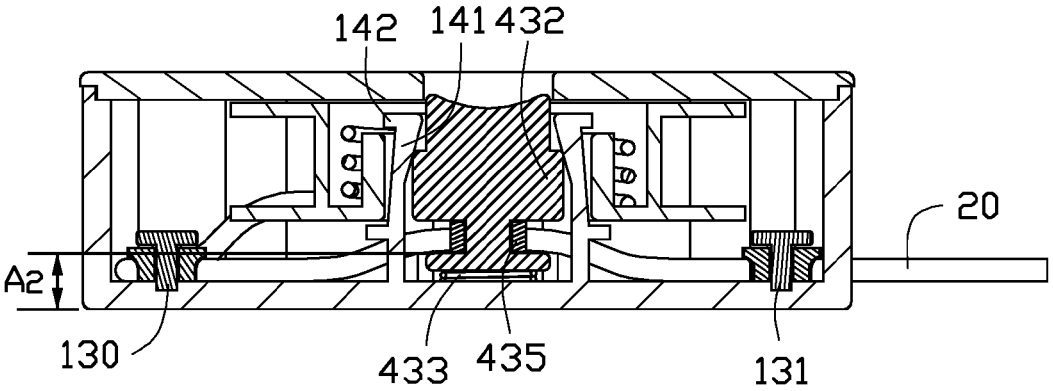
FIG. 6 is similar to FIG. 5 showing the wire winder being operated.

Referring to FIG. 6, when the wire 20 needs to be drawn out of the housing 100 through the wire hole 150, the user pulls on the outer end of the wire 20. When the wire 20 is pulled, the bent portion of the wire 20 straightens, and the through portion 435 moves towards the base plate 110 until the through portion 435 is at a position which has a second vertical distance A2 to the base plate 110. In this embodiment, the first vertical distance A1 is greater than the second vertical distance A2. In this situation, the protrusion 432 is also forced towards the base plate 110 along with the through portion 435, and detaches from the latching body 141. Thus, the latching body 141 is allowed to recover from being deformed and the latching body 141 is detached from the positioning wall 250, thereby unlocking the rotary assembly 200. During the pulling action on the wire 20, the rotary assembly 200 is unlocked and rotates in the first direction and adds more and more tension to the torsion spring 300 to store potential energy.

When the pulling action on the wire 20 is stopped, the force applied to the wire 20 is eliminated, and the elastic member 433 restores to drive the protrusion 432 away from the base plate 110 to press against and deform the latching body 141 again, so that the latching body 141 latches with the positioning wall 250 to lock the rotary assembly 200 in that position and prevent further rotation.

When the wire 20 need to be rewound, the user simply presses the button body 431 to move the protrusion 432 again towards the base plate 100. The protrusion 432 thus detaches from the latching body 141, and the deformation of the latching body 141 ceases, to allow detachment of the latching portion 140 from the positioning wall 250, thereby unlocking the rotary assembly 200. Thereupon, the built-up potential energy of the torsion spring 300 is released to rotate the rotary assembly along the second direction to automatically rewind the wire 20 around the wire winding portion 210.

In other embodiments, the rotary assembly 200 may define a protruding structure extending from an inner side of the wire winding portion 210 to replace the positioning wall 250. The protruding structure cooperates with the latching portion 140 to lock the rotary assembly 200. In addition, the first location member 130 and the second member 131 may be defined at an inner surface of the cover 500 to define the wire channel for the wire 20. The two location rollers of each of the first location member 130 and the second member 131 can be replaced by a single location roller having a through hole.

Although numerous characteristics and advantages of the present embodiments have been set out in the foregoing description, together with details of the structures and functions of the embodiments, the disclosure is illustrative only;

and changes may be made in detail, especially in the matters of shape, size and arrangement of parts within the principles of the disclosure to the full extent indicated by the broad general meaning of the terms in which the appended claims are expressed.

What is claimed is:

1. A wire winder, comprising:

a housing comprising a wire hole and a base plate;

a cover coupled to the housing;

a rotary assembly configured for winding a wire therearound, wherein the rotary assembly rotates along a first direction when the wire is drawn out of the housing and rotates along a second direction while winding the wire;

a latching portion defined in the housing and sleeved by the rotary assembly to lock or unlock the rotary assembly;

a torsion spring having two ends, one end of the torsion spring being fixed to the rotary assembly, and another end of the torsion spring being fixed to the housing or the cover, wherein the torsion spring elastically deforms to store potential energy when the rotary assembly rotates along the first direction, and releases the potential energy to rotate the rotary assembly along the second direction for winding the wire;

an operation portion received in an inner space of the latching portion and moved in a telescopic manner to make the latching portion to lock or unlock the rotary assembly;

at least one location member comprising a first location member defined at a side of the base plate; and a through portion defined on the operation portion to move together with the operation portion and allow the wire to pass therethrough;

wherein the latching portion, the rotary assembly, and the torsion spring are received in the housing, the first location member and the through portion cooperatively define a wire channel around which the wire is drawn out of or rewound into the housing, and an outer end of the wire passes through the first location member and the through portion and extends out of the housing through the wire hole.

2. The wire winder according to claim 1, wherein the at least one location member further comprises a second location member defined at another side of the base plate opposite to the first location member.

3. The wire winder according to claim 2, wherein the first location member, the second location member, and the wire hole are arranged in a straight line.

4. The wire winder according to claim 2, wherein each of the first location member and the second location member includes a pair of location rollers in contact with and clamp to wire, and each pair of location rollers define a clearance therebetween to allow the wire to pass through.

5. The wire winder according to claim 4, wherein the clearance between the pair of location rollers of the first location member is narrower than the clearance between the pair of location rollers of the second location member.

6. The wire winder according to claim 2, wherein the first location member and the second location member are located on the base plate of the housing, the through portion is located at a position which has a first vertical distance to the base plate, and the wire forms a bent portion near the through portion, when the wire is wound around the rotary assembly.

7. The wire winder according to claim 6, wherein the bent portion of the wire straightens when the wire is pulled, and the through portion moves towards the base plate to reach a position which has a second vertical distance to the base plate, and the operation moves towards the base plate along with the through portion to unlock the rotary assembly, the first vertical distance being greater than the second vertical distance.

8. The wire winder according to claim 1, wherein the latching portion includes a holding portion and a latching body, the holding portion being fixed in the housing and configured for holding the latching body, and the latching body is flexible.

9. The wire winder according to claim 8, wherein the latching portion further comprises a restriction portion defined on a top of the latching body, the inner space is defined by the holding portion, the latching body, and the restriction portion, the rotary assembly is sleeved over the latching body, and the restriction portion restricts the vertical movement of the rotary assembly to prevent the rotary assembly from moving up and down and escaping from the latching body.

10. The wire winder according to claim 9, wherein the latching body is a wedge-shaped structure extending from an edge of the holding portion, and the restriction portion is a retaining wall extending from a top edge of the latching body to a sidewall of the housing.

11. The wire winder according to claim 9, wherein the rotary assembly further comprises a base substrate, a positioning wall, and a wire winding portion extending from the base substrate configured for winding the wire, an annular groove defined between the positioning wall and the wire winding portion configured for receiving the torsion spring, and the positioning wall is sleeved on the latching body and the holding portion and is sandwiched between the base plate of the housing and the restriction portion of the latching portion.

12. The wire winder according to claim 1, wherein the operation portion presses against and deforms the latching portion to lock the rotary assembly when no external force is applied to the operation portion, and detaches from the latching portion to unlock the rotary assembly when the external force is applied to the operation portion.

13. The wire winder according to claim 12, wherein the operation portion further comprises a button body and an elastic member sleeved on one end of the button body, the button body is connected to the base plate of the housing via the elastic member, and the button body defines a protrusion pressing against the latching portion to lock the rotary assembly when no external force is applied to the operation portion and detaching from the latching portion to unlock the rotary assembly when the external force is applied to the operation portion.

14. The wire winder according to claim 1, wherein the cover defines an opening and part of the operation portion protrudes out of the housing through the opening.

* * * * *